US011180911B1

(12) United States Patent
Wu

(10) Patent No.: US 11,180,911 B1
(45) Date of Patent: Nov. 23, 2021

(54) TOILET SEAL FLANGE ASSEMBLY

(71) Applicant: Xiamen Foover Technology Co., Ltd., Xiamen (CN)

(72) Inventor: Donghong Wu, Xiamen (CN)

(73) Assignee: Xiamen Foover Technology Co., LTD, Xiamen (CN)

( * ) Notice: Subject to any disclaimer, the term of this patent is extended or adjusted under 35 U.S.C. 154(b) by 0 days.

(21) Appl. No.: 16/904,719

(22) Filed: Jun. 18, 2020

(51) Int. Cl.
*E03D 11/16* (2006.01)

(52) U.S. Cl.
CPC ..... *E03D 11/16* (2013.01)

(58) Field of Classification Search
CPC ..... E03D 11/16
See application file for complete search history.

(56) References Cited

U.S. PATENT DOCUMENTS

| | | | | |
|---|---|---|---|---|
| 3,349,412 | A * | 10/1967 | Schwartz | E03D 11/16 4/252.6 |
| 6,113,159 | A * | 9/2000 | Corbett, Jr. | F16L 21/03 264/322 |
| 7,188,376 | B2 | 3/2007 | Ortiz et al. | |
| 9,273,455 | B2 * | 3/2016 | Schuster | E03D 11/17 |
| 9,556,603 | B2 | 1/2017 | Guthrie | |
| 9,783,976 | B2 | 10/2017 | Coronado et al. | |
| 10,119,263 | B2 | 11/2018 | Coronado et al. | |
| D841,784 | S * | 2/2019 | Sharratt | D23/269 |
| 10,294,647 | B2 | 5/2019 | Coronado et al. | |

* cited by examiner

*Primary Examiner* — Janie M Loeppke
(74) *Attorney, Agent, or Firm* — Defillo & Associates; Evelyn A Defillo

(57) ABSTRACT

An improved and innovative three composites seal for connect the discharge of a toilet to the drainpipe of a drainage system to provide a desirable seal is made. A toilet seal flange assembly for sealing a plumbing fixture discharge and a waste drainpipe outlet is described. The toilet seal flange assembly includes a flange member which has an inwardly extending flexible concave lip; a compressible member with an internal support ring and, a rigid member affixed to one compressible member.

5 Claims, 13 Drawing Sheets

TOILET SEAL FLANGE ASSEMBLY

TECHNICAL FIELD

This invention relates to the field of plumbing, to connecting waste drainpipes and toilets, disclosure a sealed interconnection between a toilet and a toilet flange without wax.

BACKGROUND OF THE INVENTION

The present disclosure relates generally to a seal for connecting conduits, such as plumbing fixtures, to waste drain conduits, such as waste drainpipes. More particularly, the present disclosure is related to a universal height absorbing toilet seal that provides a sealed interconnection between a toilet and a toilet flange without wax.

A toilet seal may provide a connection between a toilet and a drainpipe. Typically, the toilet seal is a wax ring that provide a hydrophobic seal that prevent water and odor leakage. However, a big problem with the wax ring is that once it is set they may not be able to reset in a new position, due a bad installation, more over they are messy and difficult to clean in the floor or in the hands.

Since some years ago, there are few wax free flanges in the market, made with half wax and half plastic, or only with plastic and in other cases plastic and sponge. Anyway, as there are some installation variables related to the height differences between the surface of the toilet flange and the finished flooring surface there are many users complains because the toilet doesn't reach the floor, and this is due the flexibility and width of the actual flanges.

Currently, closest state of the art relating to the toilet seal flange assembly of the present invention is disclosed in various patent documents, such as U.S. Pat. Nos. 7,188,376, 9,556,603, 9,783,976, U.S. Ser. No. 10/119,263 and U.S. Ser. No. 10/294,647, which are far from having arrangement, configuration and advantages of the present invention.

Although all these documents contemplate toilet seal flange assemblies, they do not present the specific characteristics or functional versatility of present invention. On the other hand, benefits of the device presented here, will become apparent to a person with average knowledge in the area, of the following description of a preferred embodiment thereof.

SUMMARY OF THE INVENTION

A toilet seal flange assembly including: a) a flange member (10) having an inwardly extending flexible concave lip (26), a flexible sleeve (19) extending downwardly, an annular portion (13) extending downwardly and disposed radially outward from the flexible sleeve, wherein a lower surface of the flange member (10), the annular portion and the sleeve (19) cooperate to define a cavity, and two pairs of tabs (12, 18) extending outwardly of the annular portion (13), the tabs each including an opening disposed radially outward of the annular portion (13); b) a compressible member (20) with an internal support ring (29), sized to fit within the cavity and proximal to the lower surface of the flange member (10), an outer diameter of the compressible member being smaller than a diameter between the openings of the tabs of the flange member (10); and c) a rigid member (30) affixed to one compressible member (40), sized to fit within the cavity and proximal to the lower surface of the compressible member (20) and the flange member (10).

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF THE INVENTION

Figure 1:
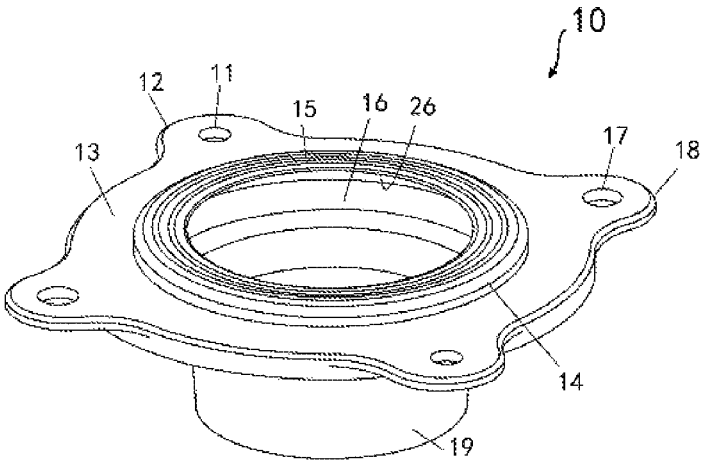
FIG. 1 illustrates a perspective view of a blue flexible rubber seal.
Figure 2:
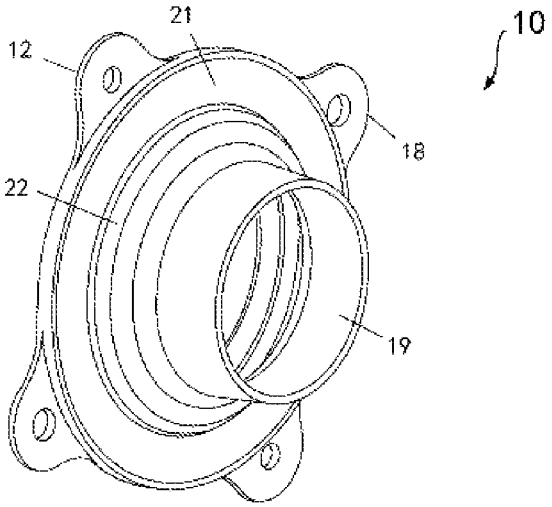
FIG. 2 illustrates a bottom perspective view of the blue flexible rubber seal of FIG. 1 with a small portion of green elastomeric joined.
Figure 3:
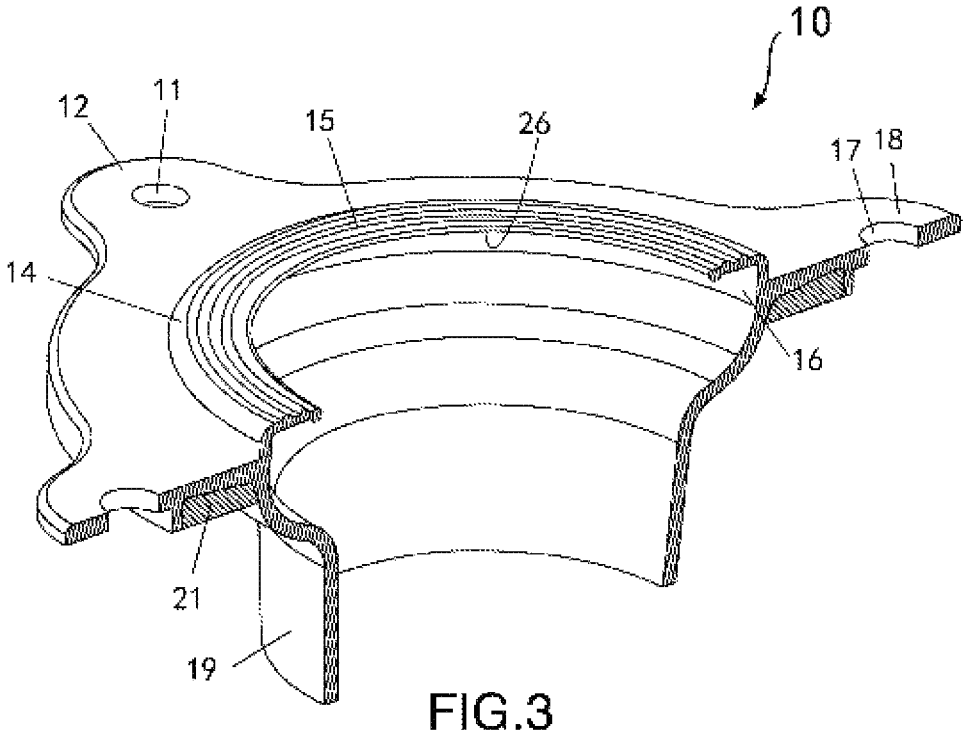
FIG. 3 illustrates a sectional view of the blue flexible rubber seal on FIG. 1.
Figure 4:
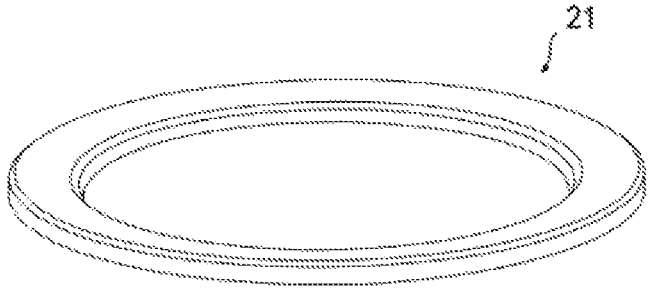
FIG. 4 illustrates a perspective view of thinner green elastic spacer in the blue flexible rubber seal.
Figure 5:
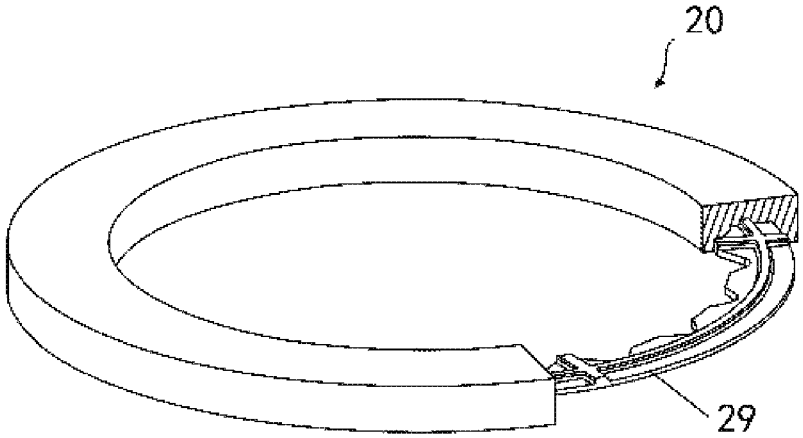
FIG. 5 illustrates a perspective view of green elastic spacer with plastic reinforcing ring.
Figure 6:
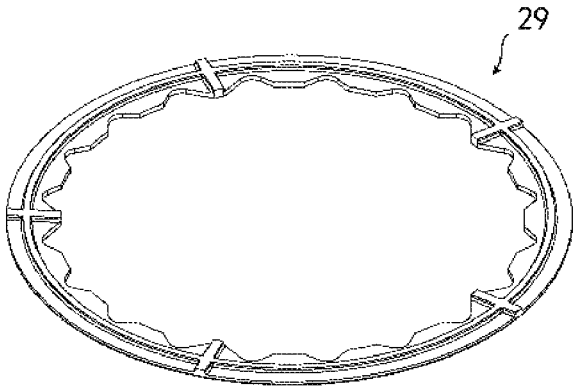
FIG. 6 illustrates a perspective view of plastic reinforcing ring.
Figure 7:
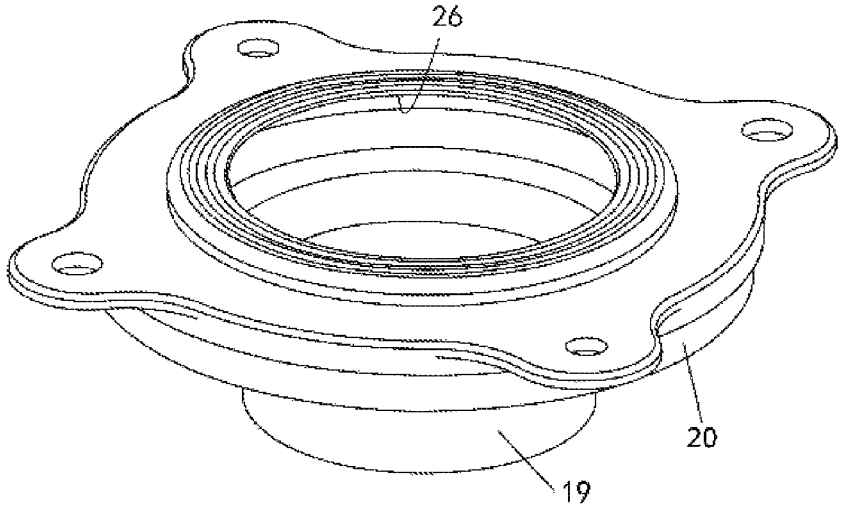
FIG. 7 illustrates a perspective view of the blue flexible rubber seal with the extra green elastic spacer.
Figure 8:
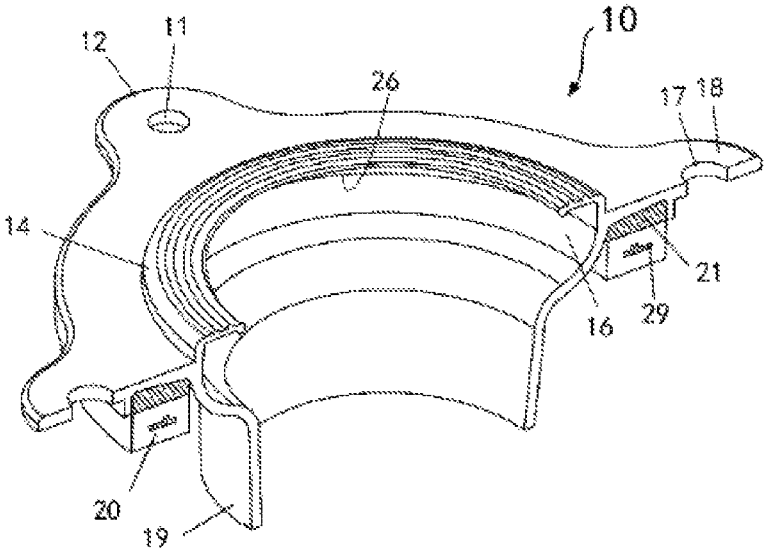
FIG. 8 illustrates a sectional view of the blue flexible rubber seal with the extra green elastic spacer.
Figure 9:
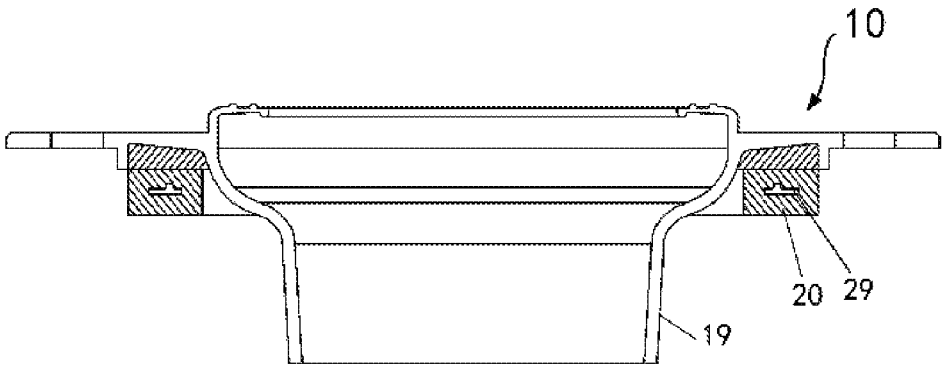
FIG. 9 illustrates a sectional side view of the of the blue flexible rubber seal with the extra green elastic spacer.
Figure 10:
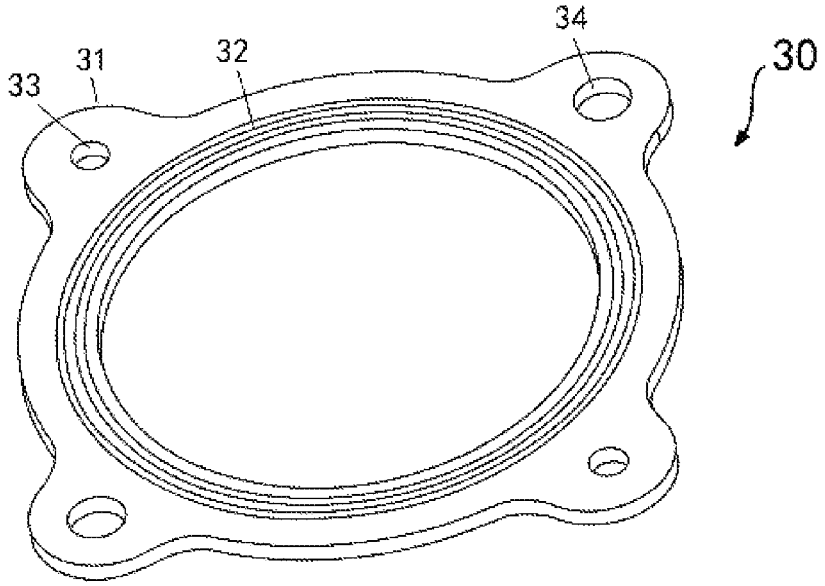
FIG. 10 illustrates a perspective view of the ABS part of the black rigid spacer.
Figure 11:
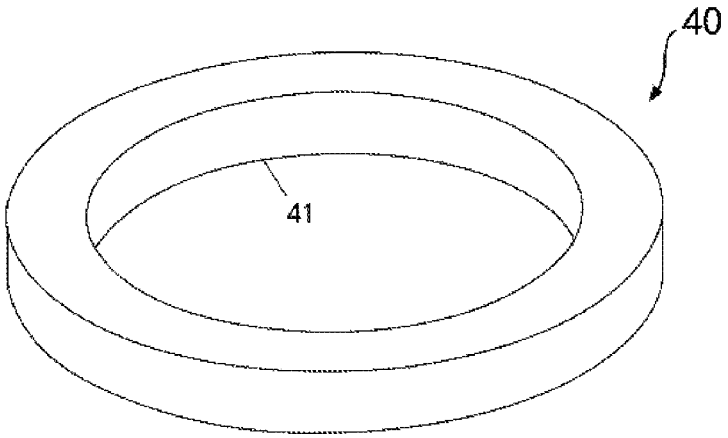
FIG. 11 illustrates a perspective view of the EVA sponge part of the black rigid spacer.
Figure 12:
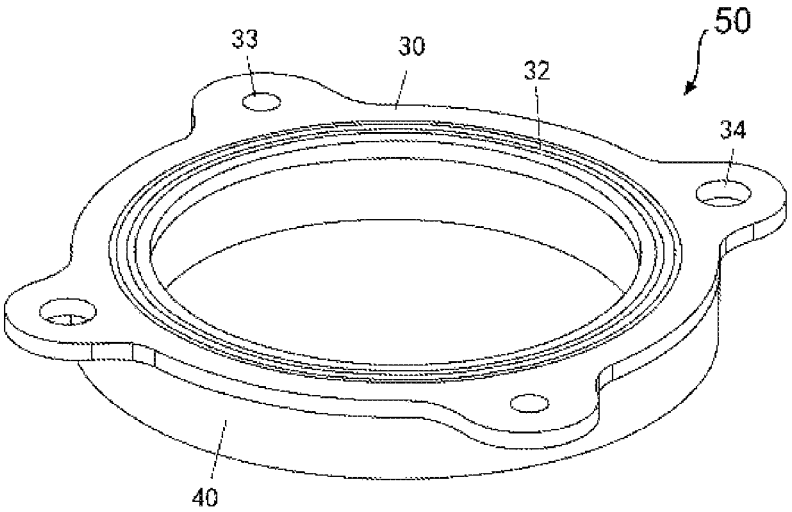
FIG. 12 illustrates a perspective view of the black rigid space made with the materials in FIG. 10 and FIG. 11.
Figure 13:
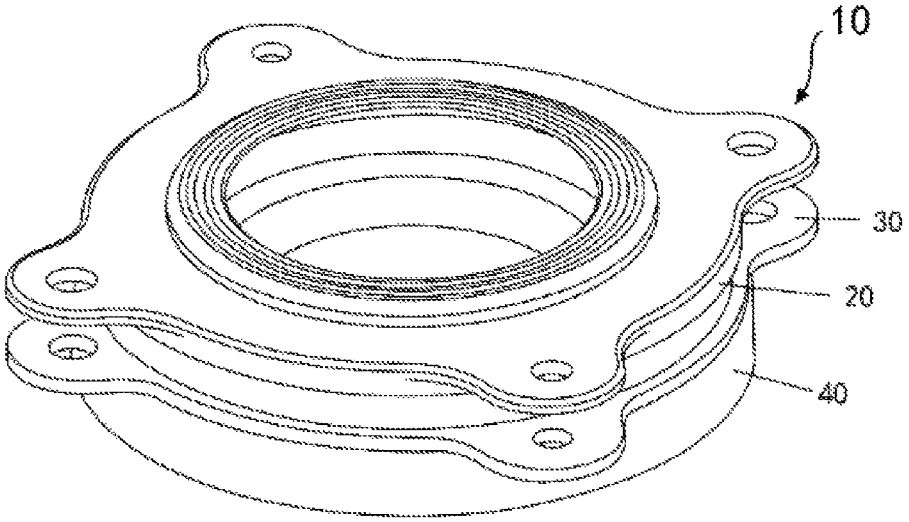
FIG. 13 illustrates a perspective view of the wax free seal three composites all together.
Figure 14:
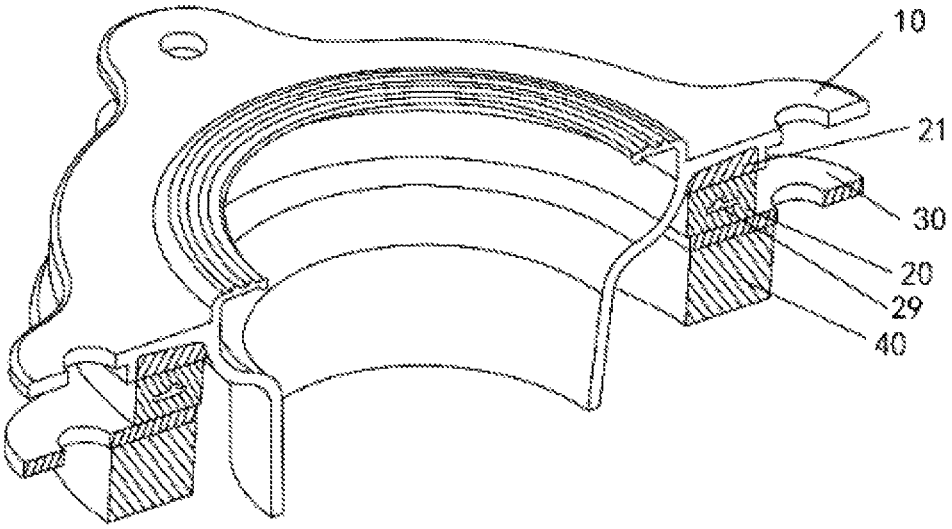
FIG. 14 illustrates a sectional view of the wax free seal three composites all together.
Figure 15:
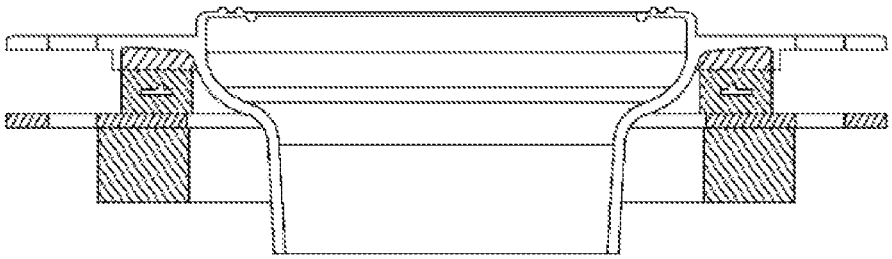
FIG. 15 illustrates a sectional side view of the wax free seal three composites all together.
Figure 16:
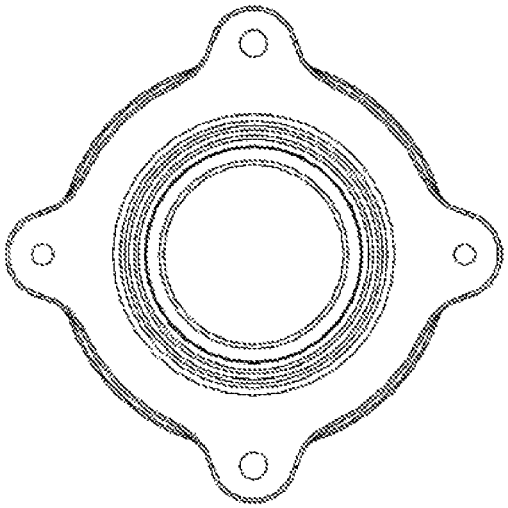
FIG. 16 illustrates a top view of the wax free seal.
Figure 17:
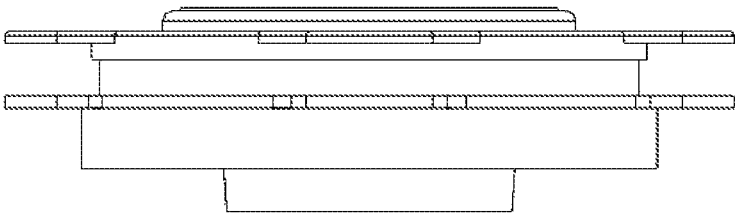
FIG. 17 illustrates a side view of the wax free seal three composites all together.
Figure 18:
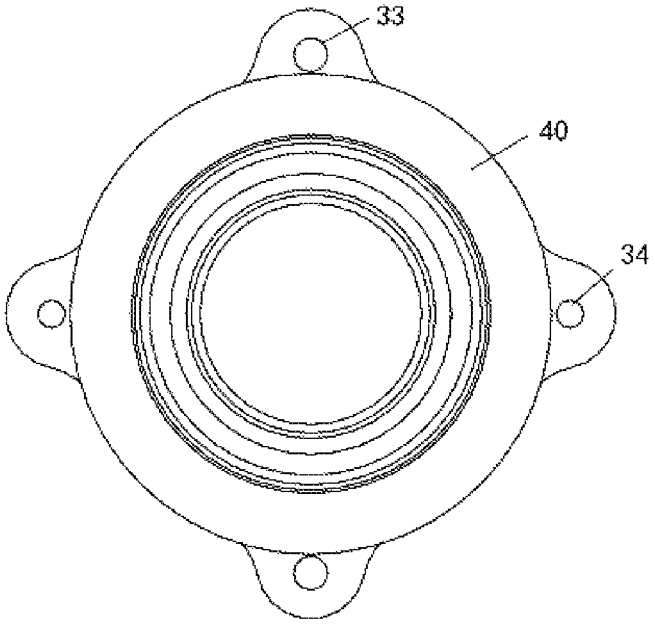
FIG. 18 illustrates a bottom view of the wax free seal three composites all together.
Figure 19:
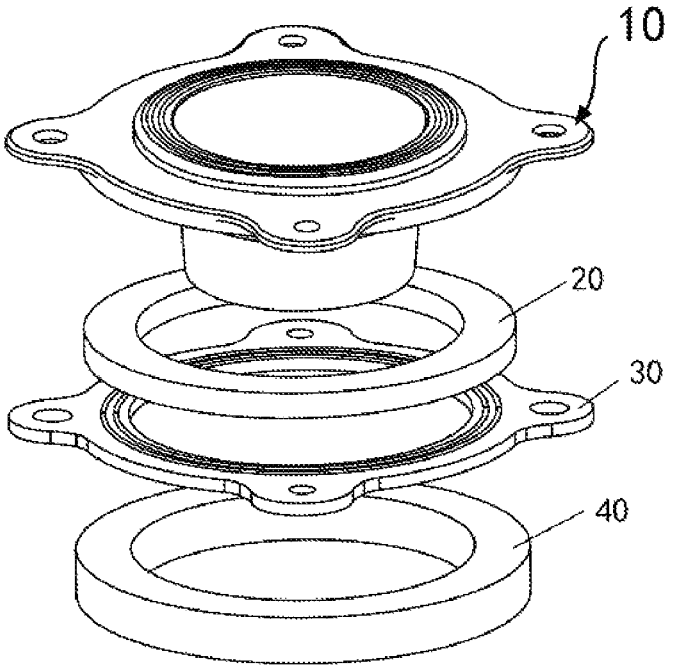
FIG. 19 illustrates an exploded view of the wax free seal three composites all together.
Figure 20:
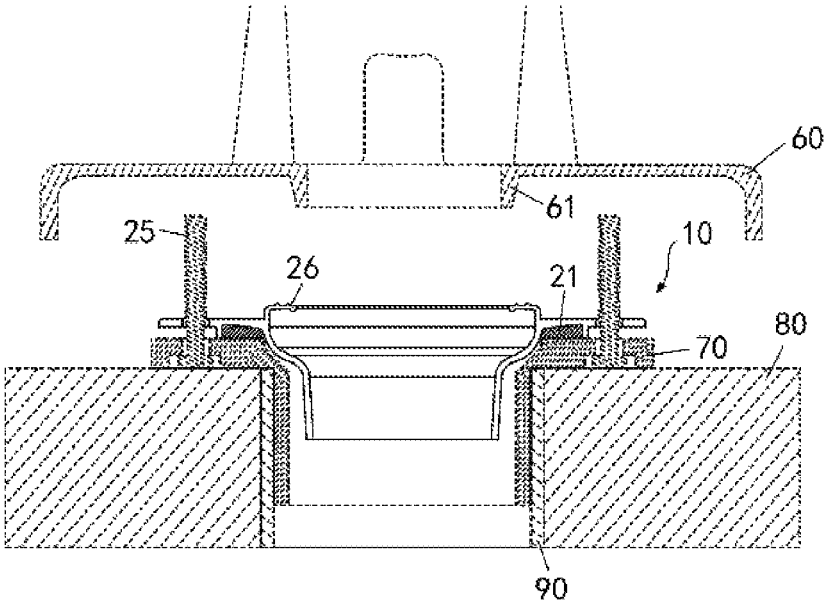
FIG. 20 illustrates a sectional view of the wax free seal having only the blue flexible rubber seal, before the installation in a toilet when the flange is above the floor.
Figure 21:
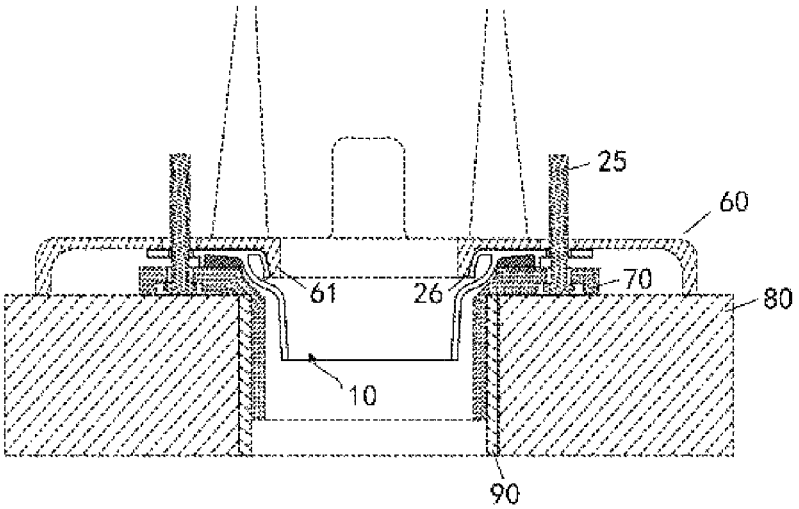
FIG. 21 illustrates a sectional view of the wax free seal having only the blue flexible rubber seal, after the installation in a toilet when the flange is above the floor.
Figure 22:
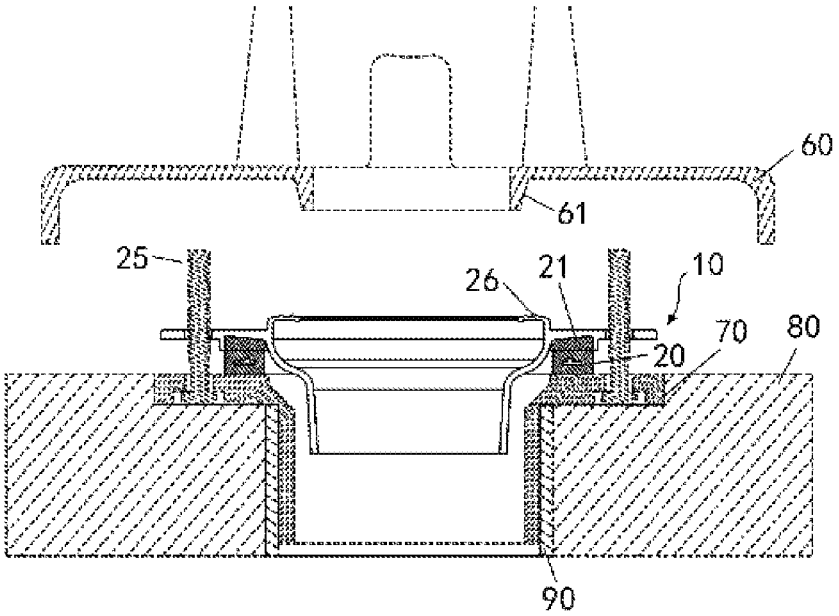
FIG. 22 illustrates a sectional view of the wax free seal having the blue flexible rubber seal and the extra green elastic spacer before the installation in a toilet when the flange is even with the floor.
Figure 23:
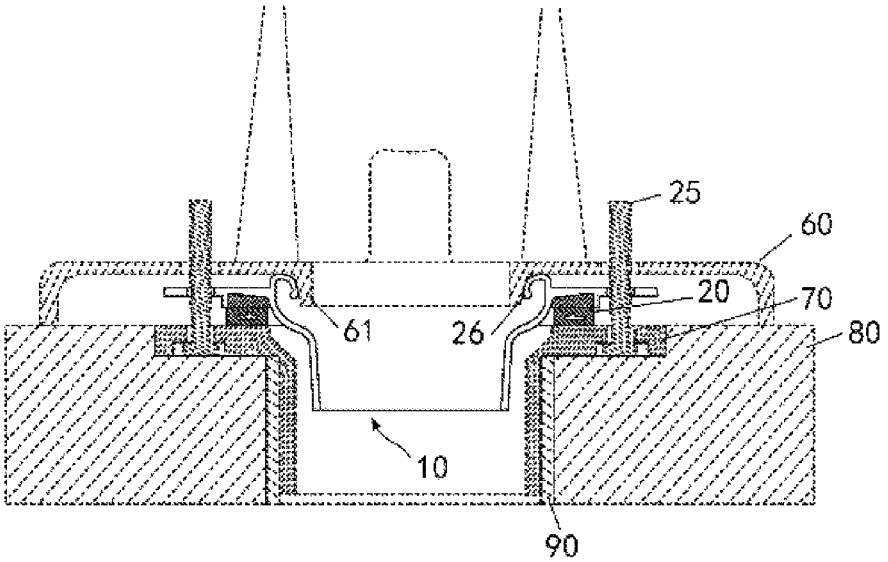
FIG. 23 illustrates a sectional view of the wax free seal having the blue flexible rubber seal and the extra green elastic spacer after the installation in a toilet when the flange is even with the floor.
Figure 24:
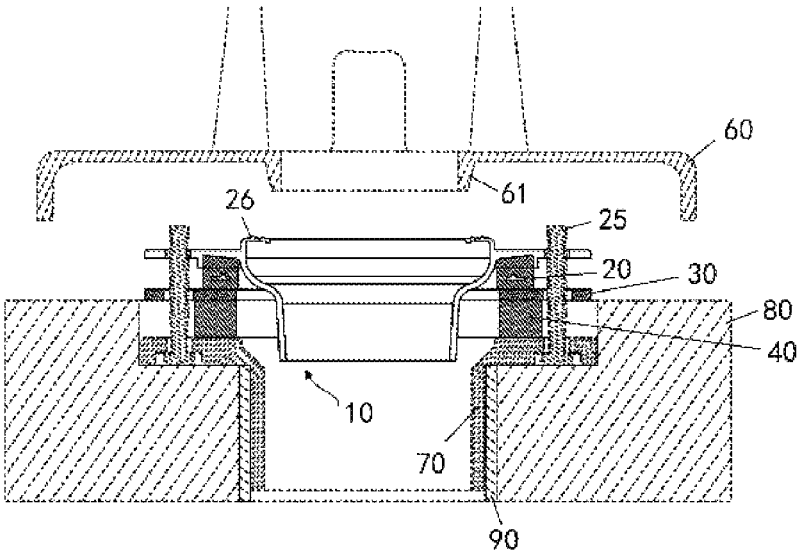
FIG. 24 illustrates a sectional view of the wax free seal having the blue flexible rubber seal, the extra green elastic spacer and the black rigid spacer before the installation in a toilet when the flange is more than ¼" below the floor.
Figure 25:
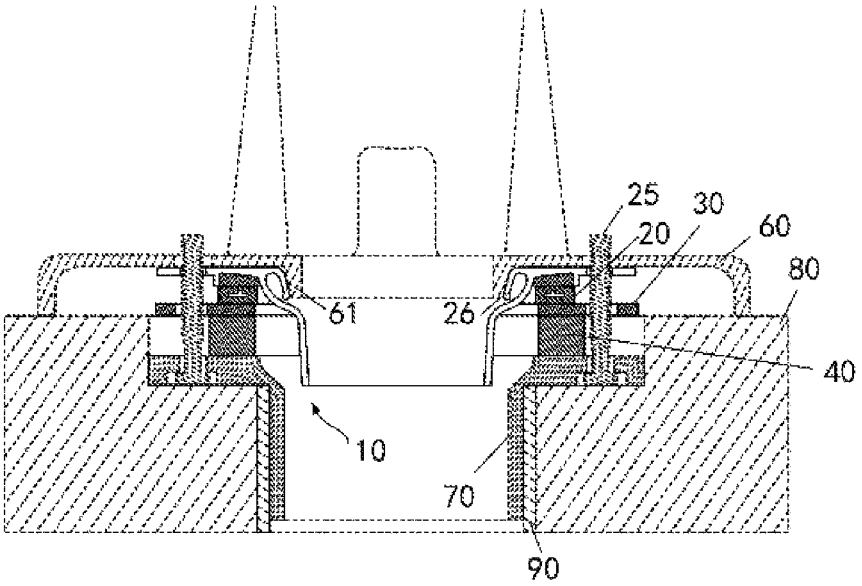
FIG. 25 illustrates a sectional view of the wax free seal having the blue flexible rubber seal, the extra green elastic spacer and the black rigid spacer after the installation in a toilet when the flange is more than ¼" below the floor.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting.

Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and make part of this disclosure.

The toilet seal flange assembly of the present invention comprising:

a) a flange member (10) which has an inwardly extending flexible concave lip (26), the flange member having a flexible sleeve (19) extending downwardly, an annular portion (13) extending downwardly and disposed radially outward from the flexible sleeve, wherein a lower surface of the flange member (10), the annular portion and the sleeve (19) cooperate to define a cavity, and two pairs of tabs (12, 18) extending outwardly of the annular portion (13), the tabs each including an opening disposed radially outward of the annular portion (13);

b) a compressible member (20) with an internal support ring (29), sized to fit within the cavity and proximal to the lower surface of the flange member (10), an outer diameter of the compressible member being smaller than a diameter between the openings of the tabs of the flange member (10);

c) a rigid member (30) affixed to one compressible member (40), sized to fit within the cavity and proximal to the lower surface of the compressible member (20) and the flange member (10).

Particularly, the compressible member (20) is disposed within the cavity and proximal to the lower surface of the flange member (10), further the compressible member (20) is fixed to the lower surface of the flange member (10). On the other hand, the rigid member (30) having a diameter substantially the same as a diameter of the compressible member (20) and, that rigid member (30) having two pair of tabs defining setting holes for receiving securing fasteners, where the tabs are situated 90° from each other about an outer circumference of the rigid member (30). Is important mention that a compressible member (21) disposed between the flange member (10) and the compressible member (20) with internal support ring (29), below annular portion (13).

Disclosed herein is a three composites wax free seal for toilets that can be installed in more common height differences between the toilet flange surface and the finished flooring surface, when the flange is above the floor, when the flange is even or up to ¼" below the floor, and when the flange is more than ¼" below the floor. The system is free of gasket waxes and comprises three composites. The three composites are, in a preferred embodiment, one blue flexible rubber seal made of nitrile butadiene rubber (NBR) and natural rubber (NR), one green elastic spacer made of an elastomer that its main components are a petroleum resin and a styrene block copolymer (SBS) and one black rigid spacer with compression EVA; that is made of ABS and EVA.

For an adequate understanding of the drawings, a list of the parts of the present invention is presented:

Flange member (10)
Tabs (12, 18) of flange member (10)
Holes (11, 17) of tabs (12, 18) of flange member (10)
Annular portion (13) of flange member (10)
Upper surface (14) of flange member (10)
Concentric seals (15) on upper surface (14) of flange member (10)
Inner aperture (16) of flange member (10)
Bottom annular portion (21) of flange member (10)
Flexible sleeve (19) of flange member (10)
Compressible member (21) of flange member (10)
Flexible concave lip (26) of flange member (10)
Compressible member (20) of flange member (10)
Internal support ring (29) of compressible member (20)
Rigid member (30)
Compressible member (40)
Composite of rigid member (30) and compressible member (40)
Tabs (31) of rigid member (30)
Concentric seals (32) of rigid member (30)
Holes (33, 34) of tabs (31) of rigid member (30)
Subflooring region (80)
Waste drainpipe outlet (90)
Toilet (60)
Toilet horn section (61)
Toilet flange (70)
Bolt (25)

Hydrostatic and tightness tests were carried out in a laboratory with an assembly of a conventional toilet with the present invention, which has an automated discharge system to verify that there was no water leakage between tank and accessory.

The assembly is composed of a traditional toilet with the accessory of the present invention. The wax free accessory is installed as any wax ring. When the switch of toilet is activated by the effect of the water level, the solenoid valve goes down and discharge the toilet automatically. After, water is pumping to fill the toilet tank, once is empty, as a normal toilet mechanism do it. The tank mechanism is the same as a normal tank, where there is a bar connected to the ballcock, and when this goes up by the action of the water, the bar active the switch, that is connected to the solenoid bar and discharge the tank. With this mechanism can simulate discharge process with wax ring or the wax free seal during a period of use and time.

Considering that four people live in a house and each one goes to the bathroom three times, it is possible to have a total of twelve discharges in a day, 360 discharges in a month, up to 43,200 discharges in ten years. The assembly allows a discharge in 45 seconds, therefore, 5 years in 2 weeks and 10 years in approximately 4 weeks are simulated.

Further, to prove a correct fit in floor level and to several height conditions, acrylic bases (25×25×1.27 cm) was used to simulate a first floor and second floor in a bathroom remodeling (floor on floor). Installation in all three conditions is easy and watertight. Several tests consisted of placing the flange at floor level. In that condition, conventional seals fail because when installing the bathroom base, they do not touch the floor. Instead, seal of present invention with greater flexibility and better design, it makes base touches completely the floor when the screws are tightened.

Due to the easy installation of the components, human errors are suppressed, such as incorrect flange alignment, incorrect centering of seals and rings, irregular bolt tension, excessive flange load, supports or fastening systems, as well as problems due to bending or vibrating, or by layered or uneven floors. The principal objective of the tests is to check that there are no leaks in the joints, connections to different components and other elements of the accessory to be tested. The tests show that there is a good seal for long periods of use and time, even with better results than similar commercial accessories, avoiding, apart from leaks, settlement failures and detachment of odors.

Therefore, unlike other assemblies, the invention of present application has shown greater efficiency in different operating areas, even in relation to commercial assemblies, with sealing means with or without wax, as it turns out to be easily assembled and repairable. Additionally, it can be coupled and adapted to different sizes and heights of pipes; maintaining the leaks control, even under sudden movements or occasional elevations of pressure, avoiding leaks or breakage during the years of assembly's useful life. Besides, due to its manageable nature and reinforcements, it allows for a secure fit even under complicated installation conditions.

Although illustrative embodiments of the invention have been described herein with reference to the accompanying drawings, it is to be understood that the embodiments of the invention are not limited to those precise embodiments, and that various other changes and modifications may be affected therein by one skilled in the art, without departing from the scope or spirit of the disclosure.

What is claimed is:

1. A toilet seal flange assembly comprising:

a) a flange member (10) having an inwardly extending flexible concave lip (26), a flexible sleeve (19) extending downwardly, an annular portion (13) extending downwardly and disposed radially outward from the flexible sleeve, wherein a lower surface of the flange member (10), the annular portion and the sleeve (19) cooperate to define a cavity, and two pairs of tabs (12, 18) extending outwardly of the annular portion (13), the tabs each including an opening disposed radially outward of the annular portion (13);

b) a compressible member (20) with an internal support ring (29), sized to fit within the cavity and proximal to the lower surface of the flange member (10), an outer diameter of the compressible member being smaller than a diameter between the openings of the tabs of the flange member (10); and c) a rigid member (30) affixed to one compressible member (40), sized to fit within the cavity and proximal to the lower surface of the compressible member (20) and the flange member (10);

wherein the internal support ring (29) includes a plurality of teeth projecting towards a center axis of the internal support ring;

wherein the rigid member (30) includes a diameter that is the same as a diameter of the compressible member (20).

2. The toilet seal flange assembly according to claim 1, wherein the compressible member (20) is disposed within the cavity and proximal to the lower surface of the flange member (10).

3. The toilet seal flange assembly according to claim 1, wherein the compressible member (20) is fixed to the lower surface of the flange member (10).

4. The toilet seal flange assembly according to claim 1, wherein the rigid member (30) includes two pair of tabs (31) defining setting holes for receiving securing fasteners, where the tabs are situated 90° from each other about an outer circumference of the rigid member (30).

5. The toilet seal flange assembly according to claim 1, further comprising a compressible member (21) disposed between the flange member (10) and the compressible member (20) with internal support ring (29), below annular portion (13).

* * * * *